US011248453B2

(12) United States Patent
Fripp et al.

(10) Patent No.: US 11,248,453 B2
(45) Date of Patent: Feb. 15, 2022

(54) SMART FRACTURING PLUG WITH FRACTURING SENSORS

(71) Applicant: HALLIBURTON ENERGY SERVICES, INC., Houston, TX (US)

(72) Inventors: Michael Linley Fripp, Carrollton, TX (US); Sean C. Canning, Carrollton, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 33 days.

(21) Appl. No.: 16/907,431

(22) Filed: Jun. 22, 2020

(65) Prior Publication Data

US 2021/0396101 A1 Dec. 23, 2021

(51) Int. Cl.

| | |
|---|---|
| ***E21B 33/12*** | (2006.01) |
| ***E21B 43/116*** | (2006.01) |
| ***E21B 43/26*** | (2006.01) |
| ***E21B 43/1185*** | (2006.01) |
| ***E21B 47/06*** | (2012.01) |
| ***E21B 47/135*** | (2012.01) |
| ***E21B 23/04*** | (2006.01) |
| ***E21B 47/07*** | (2012.01) |

(52) U.S. Cl.

CPC ..... *E21B 43/1185* (2013.01); *E21B 23/04* (2013.01); *E21B 33/12* (2013.01); *E21B 47/06* (2013.01); *E21B 47/07* (2020.05); *E21B 47/135* (2020.05); *E21B 43/26* (2013.01); *E21B 2200/08* (2020.05)

(58) Field of Classification Search

CPC ..... E21B 47/12; E21B 47/135; E21B 33/12; E21B 23/01; E21B 29/02; E21B 29/08; E21B 43/11; E21B 43/116; E21B 43/26

See application file for complete search history.

(56) References Cited

U.S. PATENT DOCUMENTS 5,343,963 A * 9/1994 Bouldin ..... E21B 34/102 175/27
6,491,098 B1 * 12/2002 Dallas ..... E21B 43/116 166/297

(Continued)

FOREIGN PATENT DOCUMENTS

WO 2013032991 A2 3/2013

OTHER PUBLICATIONS

International Search Report and Written Opinion, PCT Application No. PCT/ US2020/040306, dated Mar. 9, 2021.

*Primary Examiner* — Kenneth L Thompson
(74) *Attorney, Agent, or Firm* — Polsinelli PC

(57) ABSTRACT

Systems and methods are provided for a fracturing process and in particular, to providing a fracturing system including a fracturing plug configured to seal a wellbore to prevent fluid from passing through the wellbore, a gun configured to generate a perforation cluster, wherein the perforation cluster allows fluid exchange between the wellbore and a subterranean formation, a setting tool configured to initiate setting of the fracturing plug and firing of the gun to generate the perforation cluster, and a sensor configured to measure parameters proximate to the wellbore, wherein the sensor is retrievable after a fracturing process, measuring the parameters proximate to the wellbore with the sensor and transmitting the parameters measured by the sensor to an operator.

18 Claims, 9 Drawing Sheets

(56) References Cited

U.S. PATENT DOCUMENTS

| | | | | |
|---|---|---|---|---|
| 6,644,844 | B2 | 11/2003 | Neal et al. | |
| 6,945,330 | B2 * | 9/2005 | Wilson | E21B 23/00 166/373 |
| 7,059,407 | B2 * | 6/2006 | Tolman | E21B 17/203 166/120 |
| 7,322,416 | B2 | 1/2008 | Burris, II et al. | |
| 7,363,967 | B2 | 4/2008 | Burris, II et al. | |
| 8,272,439 | B2 * | 9/2012 | Strickland | E21B 47/09 166/255.2 |
| 9,528,360 | B2 * | 12/2016 | Castillo | E21B 43/116 |
| 9,926,755 | B2 * | 3/2018 | Van Petegem | E21B 41/005 |
| 10,119,351 | B2 * | 11/2018 | Flores | E21B 29/08 |
| 10,392,893 | B2 * | 8/2019 | Hogan | E21B 33/068 |
| 10,738,577 | B2 * | 8/2020 | Varkey | E21B 47/06 |
| 2013/0213665 | A1 * | 8/2013 | O'Malley | E21B 33/134 166/373 |
| 2017/0175500 | A1 | 6/2017 | Robey et al. | |
| 2017/0314372 | A1 | 11/2017 | Tolman et al. | |
| 2018/0128070 | A1 * | 5/2018 | Chang | E21B 41/00 |
| 2018/0252091 | A1 | 9/2018 | Bustos et al. | |
| 2018/0328120 | A1 | 11/2018 | Therrien et al. | |

* cited by examiner

SMART FRACTURING PLUG WITH FRACTURING SENSORS

TECHNICAL FIELD

The present technology pertains to hydraulic fracturing and in particular, to the use of smart sensors to improve the monitoring of drilling operations based on real-time data.

BACKGROUND

Completion of a wellbore through hydraulic fracturing is a complex process. The hydraulic fracturing process includes a number of different variables that can be altered to perform a well completion. Specifically, parameters related to perforation initiation and creation, e.g. through a plug-and-perf technique, can be altered during a hydraulic fracturing process to perform a well completion. Furthermore, parameters related to fracture creation and stabilization can be altered during a hydraulic fracturing process to perform a well completion.

Currently, fracturing jobs are performed by operators that rely heavily on their own knowledge and experience to complete a well. Hydraulic fracturing technologies have developed to provide real time fracturing data to operators performing a fracturing job. However, operators still rely on their own knowledge and experience to interpret this real time fracturing data and perform a well completion. This is problematic as operators are often unable to properly interpret the wealth of real time fracturing data that is gathered and provided to them in order to control a hydraulic fracturing job.

Specifically, as the hydraulic fracturing process is complex and encompasses a number of different variables that can be altered to perform a well completion, it becomes difficult for operators to alter the variables of the hydraulic fracturing process based on real time fracturing data to properly control a hydraulic fracturing job. As a result, operators tend to rely more heavily on their own knowledge and experience instead of real time fracturing data to control a hydraulic fracturing process, often leading to detrimental effects on a well completion job.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
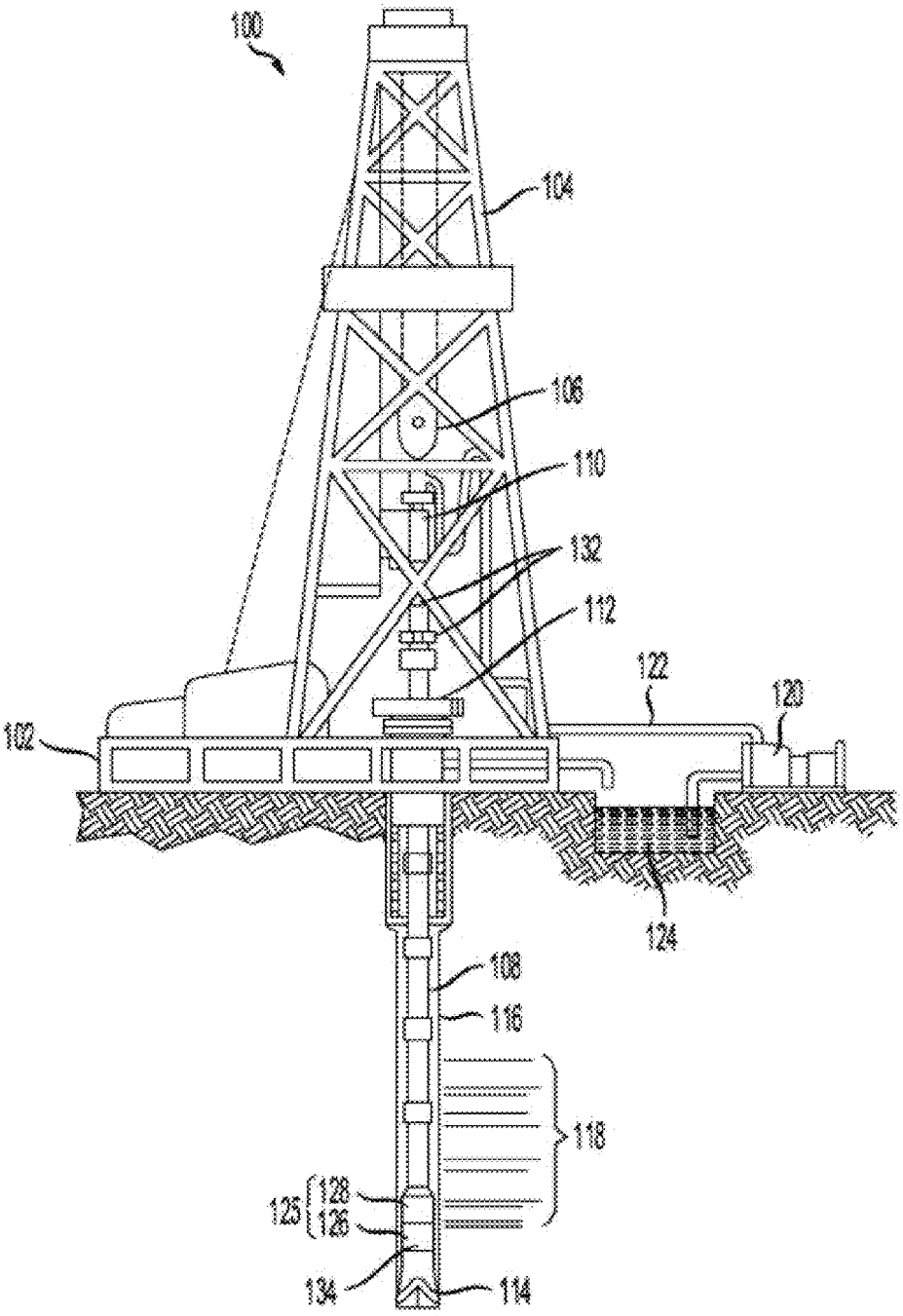
FIG. 1A is a schematic diagram of an example logging while drilling (LWD) wellbore operating environment, in accordance with some examples.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Subterranean hydraulic fracturing is conducted to increase or "stimulate" production from a hydrocarbon well. To conduct a fracturing process, pressure is used to pump special fracturing fluids, including some that contain propping agents ("proppants"), down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons.

To begin a fracturing process, at least one perforation is made at a particular down-hole location through the well into a subterranean formation, e.g. through a wall of the well casing, to provide access to the formation for the fracturing fluid. The direction of the perforation attempts to determine at least the initial direction of the fracture.

A first "mini-fracture" test can be conducted in which a relatively small amount of proppant-free fracturing fluid is pumped into the formation to determine and/or confirm at least some of the properties of the formation, such as the permeability of the formation itself. Accurately knowing the permeability allows for a prediction of the fluid leak-off rate at various pressures, whereby the amount of fracturing fluid that will flow into the formation can be considered in establishing a pumping and proppant schedule. Thus, the total amount of fluid to be pumped down-hole is at least the sum of the hold-up of the well, the amount of fluid that fills the fracture, and the amount of fluid that leaks off into the formation, the formation matrix, microfractures, natural fractures, failed or otherwise sheared fractures, and/or bedding planes during the fracturing process itself. Leak-off rate is an important parameter because once proppant-laden fluid is pumped into the fracture, leak-off can increase the concentration of the proppant in the fracturing fluid beyond a target level. Data from the mini-fracture test then is usually used by experts to confirm or modify the original desired target profile of the fracture and the completion process used to achieve the fracture.

Fracturing then begins in earnest by first pumping proppant-free fluid into the wellbore or through tubing. The fracture is initiated and begins to grow in height, length, and/or width. This first proppant-free stage is usually called the "pre-pad" and consists of a low viscosity fluid. A second fluid pumping stage is usually then conducted of a different viscosity proppant-free fluid called the "pad." At a particular time in the pumping process, the proppant is then added to a fracturing and propping flow stream using a continuous blending process, and is usually gradually stepped-up in proppant concentration. The resultant fractures are then filled with a sufficient quantity of proppant to stabilize the fractures.

This process can be repeated in a plurality of fracturing stages to form a plurality of fractures through a wellbore, e.g. as part of a well completion phase. In particular, this process can be repeatedly performed through a plug-and-perf technique to form the fractures throughout a subterranean formation. After the fractures are formed, resources, e.g., hydrocarbons, can be extracted from the fractures during a well production phase.

As discussed previously, completion of a wellbore through hydraulic fracturing is a complex process. The hydraulic fracturing process includes a number of different variables that can be altered to perform a well completion. Specifically, parameters related to perforation initiation and creation, e.g. through a plug-and-perf technique, can be altered during a hydraulic fracturing process to perform a well completion. For example, spacing of perforations and/or a number of perforations in a perforation cluster can be adjusted during a perforation initiation and creation stage.

Furthermore, parameters related to fracture initiation and stabilization can be altered during a hydraulic fracturing process to perform a well completion. For example, a flow rate of an additive material can be adjusted during a fracture initiation and stabilization stage. Humans, however, are typically incapable of tracking and controlling all of the different variables of the hydraulic fracturing process. This can lead to inefficient and improper completion of the wellbore through the hydraulic fracturing process. For example, a human can fail to account for all of the variables during the hydraulic fracturing process that lead to screen outs, thereby leading to screen outs during a well completion.

Currently, fracturing jobs are typically performed by operators that rely heavily on their own knowledge and experience to complete a well. Hydraulic fracturing technologies have developed to provide real time fracturing data to operators performing a fracturing job. For example, wellhead pressures can be captured and presented to an operator during a fracturing job. However, operators still rely on their own knowledge and experience to interpret this real time fracturing data and perform a well completion. This is problematic as operators, as discussed previously, are often unable to properly interpret the wealth of real time fracturing data that is gathered and provided to them in order to control a hydraulic fracturing job.

Specifically, as the hydraulic fracturing process is complex and encompasses a number of different variables that can be altered to perform a well completion, it becomes difficult for operators to alter the variables of the hydraulic fracturing process based on real time fracturing data to properly control a hydraulic fracturing job. As a result, operators tend to rely more heavily on their own knowledge and experience instead of real time fracturing data to control a hydraulic fracturing process, often leading to detrimental effects on a well completion. For example, an operator can observe that a wellhead pressure during a fracturing job is less than a previously observed wellhead pressure. In turn, the operator can rely on personal knowledge and mistakenly compensate for this difference in wellhead pressure by increasing a fluid flow rate into the wellbore. However, increasing the fluid flow rate can lead to the creation of runaway fractures during the well completion.

Disclosed are systems and methods for monitoring drilling operations based on real-time data with smart sensors.

According to at least one aspect, an example system for monitoring drilling operations based on real-time data with smart sensors is provided. The system can include a fracturing plug configured to seal a wellbore to prevent fluid from passing through the wellbore; a gun configured to generate a perforation cluster, wherein the perforation cluster allows fluid exchange between the wellbore and a subterranean formation; a setting tool configured to initiate setting of the fracturing plug and firing of the gun to generate the perforation cluster; and a sensor configured to measure parameters proximate to the wellbore, wherein the sensor is retrievable after a fracturing process.

According to at least one aspect, an example method for monitoring drilling operations based on real-time data with smart sensors is provided. The method can include providing a fracturing system comprising: a fracturing plug configured to seal a wellbore to prevent fluid from passing through the wellbore; a gun configured to generate a perforation cluster, wherein the perforation cluster allows fluid exchange between the wellbore and a subterranean formation; a setting tool configured to initiate setting of the fracturing plug and firing of the gun to generate the perforation cluster; and a sensor configured to measure parameters proximate to the wellbore, wherein the sensor is retrievable after a fracturing process; measuring the parameters proximate to the wellbore with the sensor; and transmitting the parameters measured by the sensor to an operator.

In some aspects, the systems and methods described above can include the fracturing plug, the gun, and the setting tool being dissolvable; the perforation clusters including a plurality of holes that allow the fluid exchange between the wellbore and the subterranean formation; the perforation clusters including varying diameters that are based on the type of the fracturing process; the parameters measured by the sensor including at least one of a temperature parameter and a pressure parameter; further comprising a plurality of sensors including the sensor that are distributed throughout the wellbore; further comprising a transponder that is configured to be communicatively coupled to the plurality of sensors; the transponder being configured to: receive the measured parameters from the plurality of sensors, and transmit the measured parameters to an operator; further comprising: a casing that encapsulates the wellbore, and a data line embedded within the casing that is configured to be communicatively coupled to the sensor; and the data line being a fiber optic cable that is configured to wirelessly receive the measured parameters from the sensor.

Figure 8:
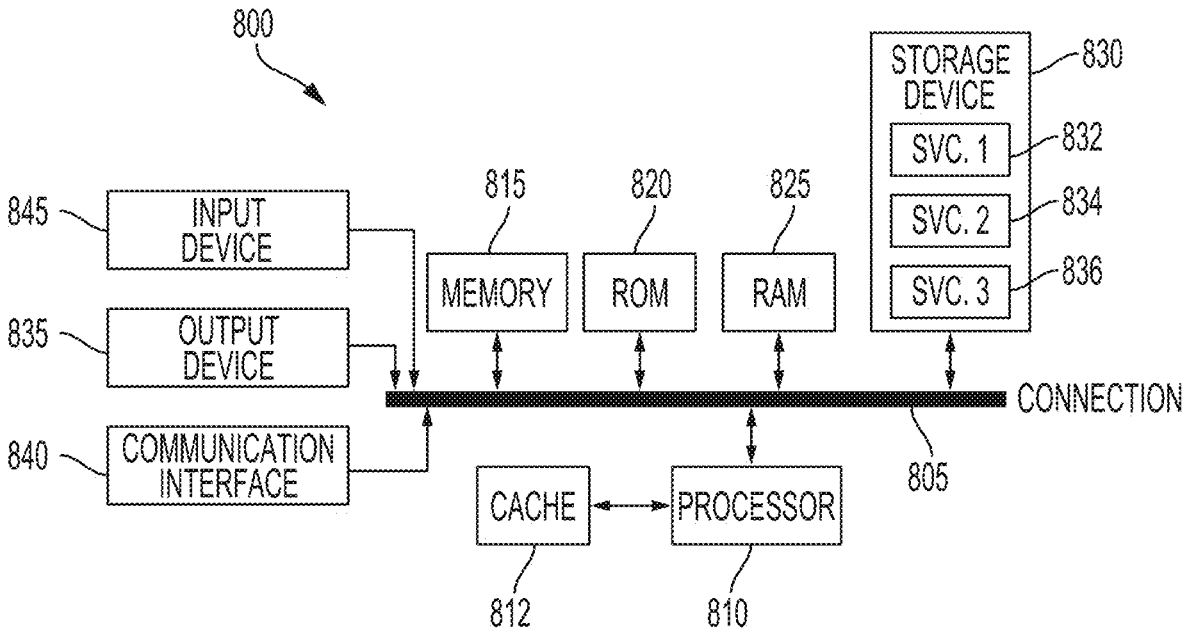
FIG. 8 is a schematic diagram of an example computing device architecture, in accordance with some examples.

As follows, the disclosure will provide a more detailed description of the systems and methods and techniques herein for monitoring drilling operations based on real-time data with smart sensors. The disclosure includes example systems, environments, methods, and technologies for using sensors to improve monitoring of drilling operations. The disclosure concludes with a description of an example computing system architecture, as shown in FIG. 8, which can be implemented for performing computing operations and functions disclosed herein. These variations shall be described herein as the various embodiments are set forth.

The disclosure now turns to FIG. 1A, which illustrates a schematic view of a logging while drilling (LWD) wellbore operating environment 100 in in accordance with some examples of the present disclosure. As depicted in FIG. 1A, a drilling platform 102 can be equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, the drill bit 114 creates a wellbore 116 that passes through various formations 118. A pump 120 circulates drilling fluid through a supply pipe 122 to top drive 110, down through the interior of drill string 108 and orifices in drill bit 114, back to the surface via the annulus around drill string 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled with one or more wires and/or other media. The logging tools 126 may also include one or more computing devices 134 communicatively coupled with one or more of the one or more tool components by one or more wires and/or other media. The one or more computing devices 134 may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Figure 1B:
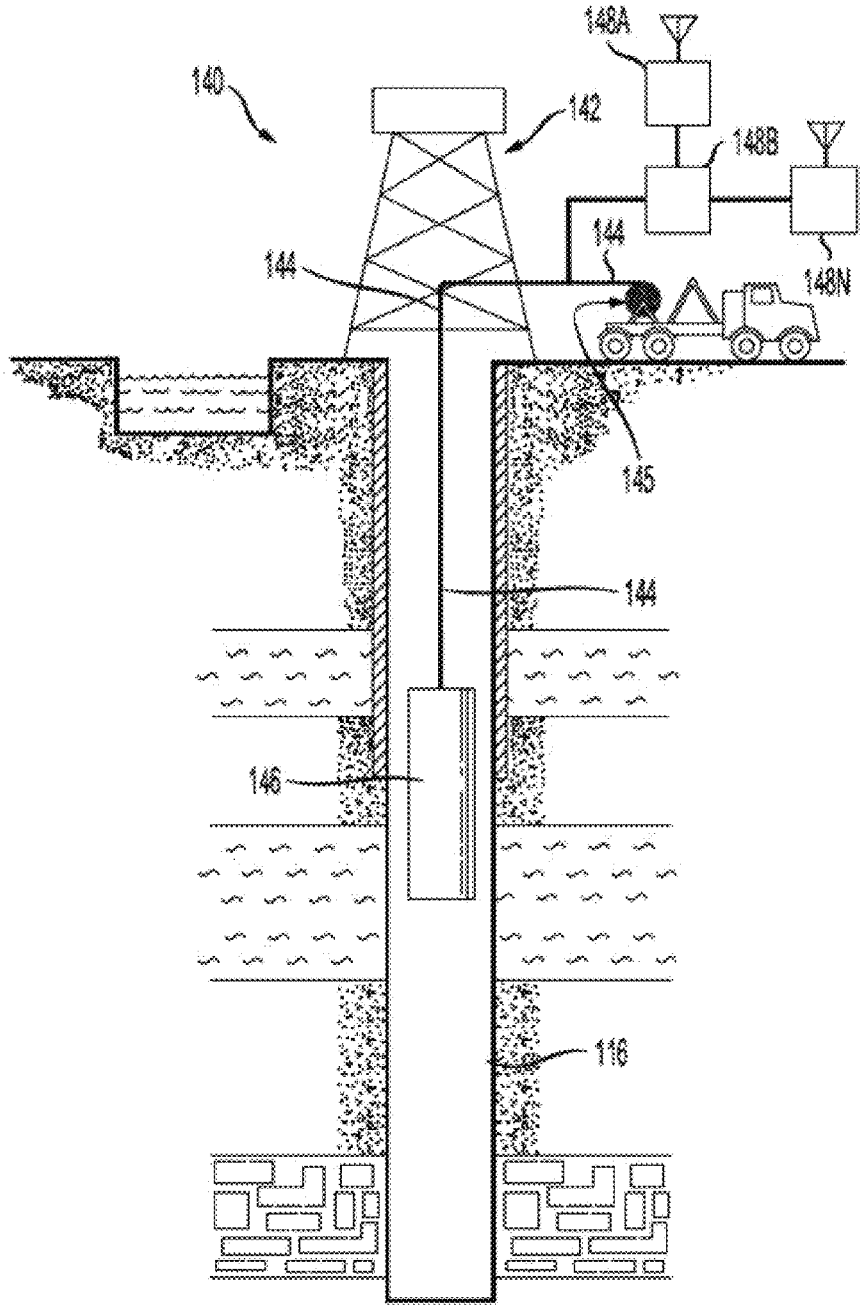
FIG. 1B is a schematic diagram of an example downhole environment having tubulars, in accordance with some examples.

Referring to FIG. 1B, an example system 140 for downhole line detection in a downhole environment having tubulars can employ a tool having a tool body 146 in order to carry out logging and/or other operations. For example, instead of using the drill string 108 of FIG. 1A to lower tool body 146, which may contain sensors or other instrumentation for detecting and logging nearby characteristics and conditions of the wellbore 116 and surrounding formation, a wireline conveyance 144 can be used. The tool body 146 can include a resistivity logging tool. The tool body 146 can be lowered into the wellbore 116 by wireline conveyance 144. The wireline conveyance 144 can be anchored in the drill rig 145 or a portable means such as a truck. The wireline conveyance 144 can include one or more wires, slicklines, cables, and/or the like, as well as tubular conveyances such as coiled tubing, joint tubing, or other tubulars.

The illustrated wireline conveyance 144 provides support for the tool, as well as enabling communication between tool processors 148A-N on the surface and providing a power supply. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
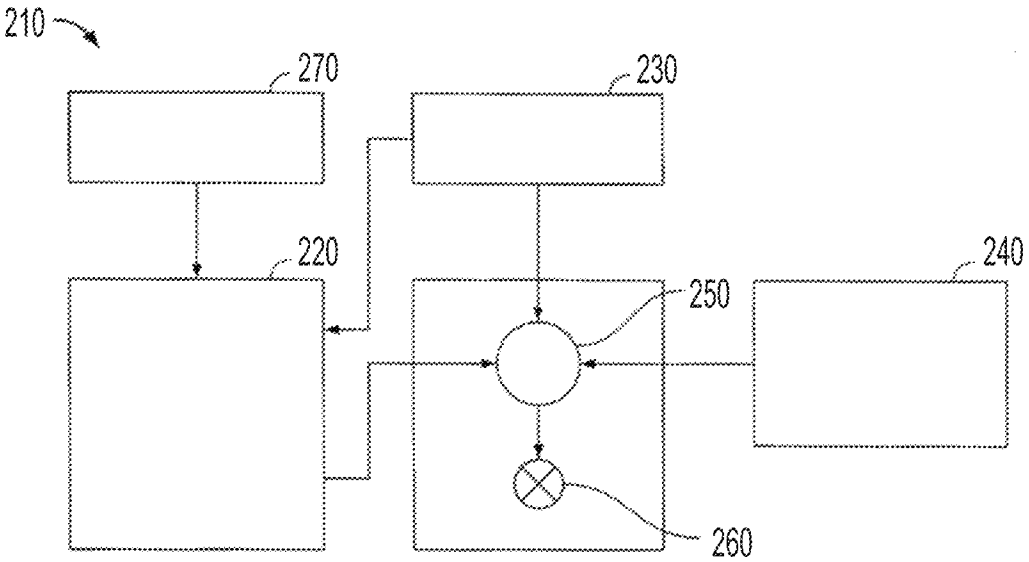
FIG. 2 is a schematic diagram of an example fracturing system, in accordance with various aspects of the subject technology.

Turning now to FIG. 2, an example fracturing system 210 is shown. The example fracturing system 210 shown in FIG. 2 can be implemented using the systems, methods, and techniques described herein. In particular, the disclosed system, methods, and techniques may directly or indirectly affect one or more components or pieces of equipment associated with the example fracturing system 210, according to one or more embodiments. The fracturing system 210 includes a fracturing fluid producing apparatus 220, a fluid source 230, a solid source 240, and a pump and blender system 250. All or an applicable combination of these components of the fracturing system 210 can reside at the surface at a well site/fracturing pad where a well 260 is located.

During a fracturing job, the fracturing fluid producing apparatus 220 can access the fluid source 230 for introducing/controlling flow of a fluid, e.g. a fracturing fluid, in the fracturing system 210. While only a single fluid source 230 is shown, the fluid source 230 can include a plurality of separate fluid sources. Further, the fracturing fluid producing apparatus 220 can be omitted from the fracturing system 210. In turn, the fracturing fluid can be sourced directly from the fluid source 230 during a fracturing job instead of through the intermediary fracturing fluid producing apparatus 220.

The fracturing fluid can be an applicable fluid for forming fractures during a fracture stimulation treatment of the well 260. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 260. In certain embodiments, the fracturing fluid can include a gel pre-cursor with fluid, e.g. liquid or substantially liquid, from fluid source 230. Accordingly, the gel pre-cursor with fluid can be mixed by the fracturing fluid producing apparatus 220 to produce a viscous fracturing fluid for forming fractures.

The solid source 240 can include a volume of one or more solids for mixture with a fluid, e.g. the fracturing fluid, to form a solid-laden fluid. The solid-laden fluid can be pumped into the well 260 as part of a solids-laden fluid stream that is used to form and stabilize fractures in the well 260 during a fracturing job. The one or more solids within the solid source 240 can include applicable solids that can be added to the fracturing fluid of the fluid source 230. Specifically, the solid source 240 can contain one or more proppants for stabilizing fractures after they are formed during a fracturing job, e.g. after the fracturing fluid flows out of the formed fractures. For example, the solid source 240 can contain sand.

The fracturing system 210 can also include additive source 270. The additive source 270 can contain/provide one or more applicable additives that can be mixed into fluid, e.g. the fracturing fluid, during a fracturing job. For example, the additive source 270 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives can function to maintain solid particle suspension in a mixture of solid particles and fracturing fluid as the mixture is pumped down the well 260 to one or more perforations.

The pump and blender system 250 functions to pump fracture fluid into the well 260. Specifically, the pump and blender system 250 can pump fracture fluid from the fluid source 230, e.g. fracture fluid that is received through the fracturing fluid producing apparatus 220, into the well 260 for forming and potentially stabilizing fractures as part of a fracture job. The pump and blender system 250 can include one or more pumps. Specifically, the pump and blender system 250 can include a plurality of pumps that operate together, e.g. concurrently, to form fractures in a subterranean formation as part of a fracturing job. The one or more pumps included in the pump and blender system 250 can be an applicable type of fluid pump. For example, the pumps in the pump and blender system 250 can include electric pumps and/or gas powered pumps.

The pump and blender system 250 can also function to receive the fracturing fluid and combine it with other components and solids. Specifically, the pump and blender system 250 can combine the fracturing fluid with volumes of solid particles, e.g. proppant, from the solid source 240 and/or additional fluid and solids from the additive source 270. In turn, the pump and blender system 250 can pump the resulting mixture down the well 260 at a sufficient pumping rate to create or enhance one or more fractures in a subterranean zone, for example, to stimulate production of fluids from the zone. While the pump and blender system 250 is described to perform both pumping and mixing of fluids and/or solid particles, in various embodiments, the pump and blender system 250 can function to just pump a fluid stream, e.g. a fracture fluid stream, down the well 260 to create or enhance one or more fractures in a subterranean zone.

The fracturing fluid producing apparatus 220, fluid source 230, and/or solid source 240 may be equipped with one or more monitoring devices (not shown). The monitoring devices can be used to control the flow of fluids, solids, and/or other compositions to the pumping and blender system 250. Such monitoring devices can effectively allow the pumping and blender system 250 to source from one, some or all of the different sources at a given time. In turn, the pumping and blender system 250 can provide just fracturing fluid into the well at some times, just solids or solid slurries at other times, and combinations of those components at yet other times.

Figure 3:
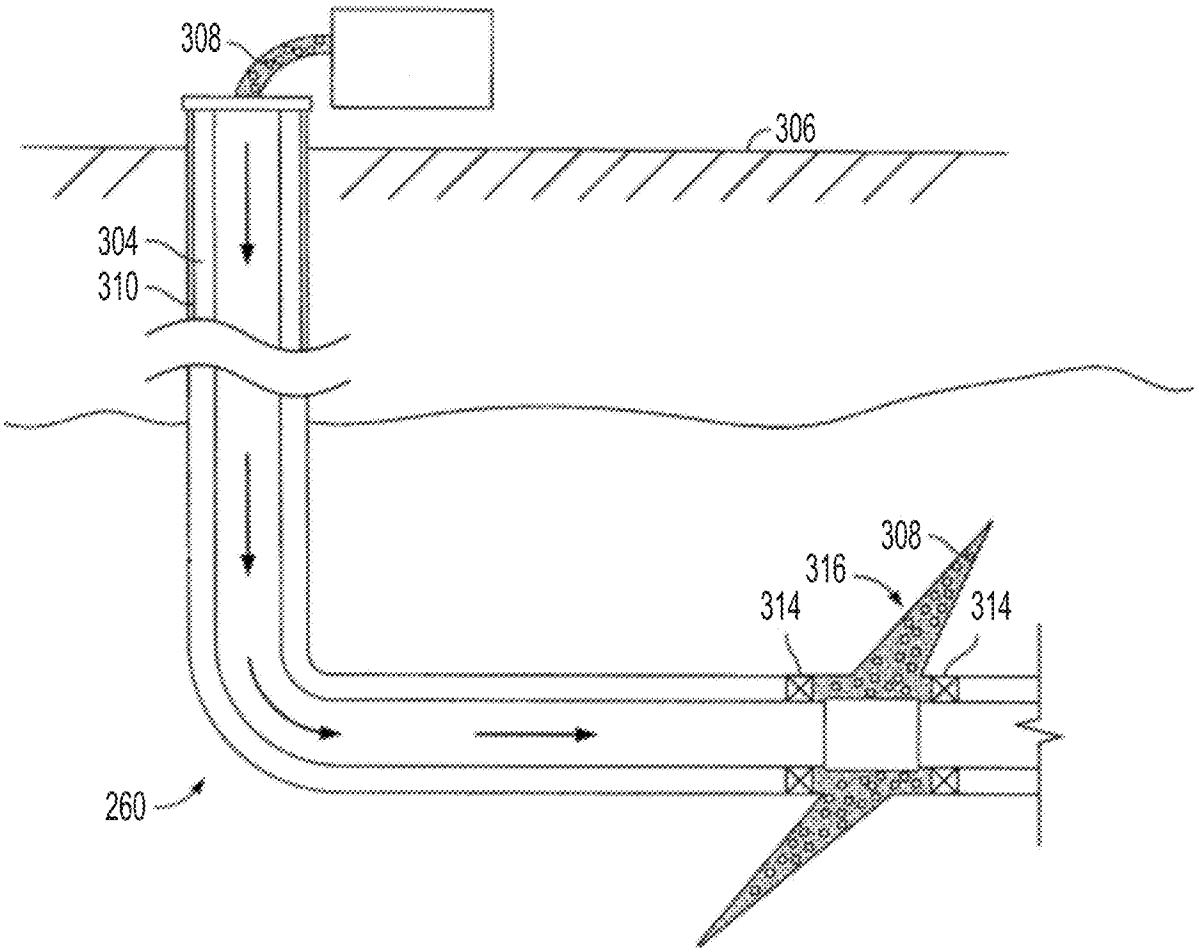
FIG. 3 illustrates a well during a fracturing operation in a portion of a subterranean formation of interest surrounding a wellbore, in accordance with various aspects of the subject technology.

FIG. 3 shows the well 260 during a fracturing operation in a portion of a subterranean formation of interest 302 surrounding a wellbore 304. The fracturing operation can be performed using one or an applicable combination of the components in the example fracturing system 210 shown in FIG. 2. The wellbore 304 extends from the surface 306, and the fracturing fluid 308 is applied to a portion of the subterranean formation 302 surrounding the horizontal portion of the wellbore. Although shown as vertical deviating to horizontal, the wellbore 304 may include horizontal, vertical, slant, curved, and other types of wellbore geometries and orientations, and the fracturing treatment may be applied to a subterranean zone surrounding any portion of the wellbore 304. The wellbore 304 can include a casing 310 that is cemented or otherwise secured to the wellbore wall. The wellbore 304 can be uncased or otherwise include uncased sections. Perforations can be formed in the casing 310 to allow fracturing fluids and/or other materials to flow into the subterranean formation 302. As will be discussed in greater detail below, perforations can be formed in the casing 310 using an applicable wireline-free actuation. In the example fracture operation shown in FIG. 3, a perforation is created between points 314.

The pump and blender system 250 is fluidly coupled to the wellbore 304 to pump the fracturing fluid 308, and potentially other applicable solids and solutions into the wellbore 304. When the fracturing fluid 308 is introduced into wellbore 304 it can flow through at least a portion of the wellbore 304 to the perforation, defined by points 314. The fracturing fluid 308 can be pumped at a sufficient pumping rate through at least a portion of the wellbore 304 to create one or more fractures 316 through the perforation and into the subterranean formation 302. Specifically, the fracturing fluid 308 can be pumped at a sufficient pumping rate to create a sufficient hydraulic pressure at the perforation to form the one or more fractures 316. Further, solid particles, e.g. proppant from the solid source 240, can be pumped into the wellbore 304, e.g. within the fracturing fluid 308 towards the perforation. In turn, the solid particles can enter the fractures 316 where they can remain after the fracturing fluid flows out of the wellbore. These solid particles can stabilize or otherwise "prop" the fractures 316 such that fluids can flow freely through the fractures 316.

While only two perforations at opposing sides of the wellbore 304 are shown in FIG. 3, as will be discussed in greater detail below, greater than two perforations can be formed in the wellbore 304, e.g. along the top side of the wellbore 304, as part of a perforation cluster. Further, multiple perforation clusters can be included in or otherwise formed during a single fracturing stage. Fractures can then be formed through the plurality of perforations in the perforation cluster as part of a fracturing stage for the perforation cluster. Specifically, fracturing fluid and solid particles can be pumped into the wellbore 304 and pass through the plurality of perforations during the fracturing stage to form and stabilize the fractures through the plurality of perforations.

Figure 4:
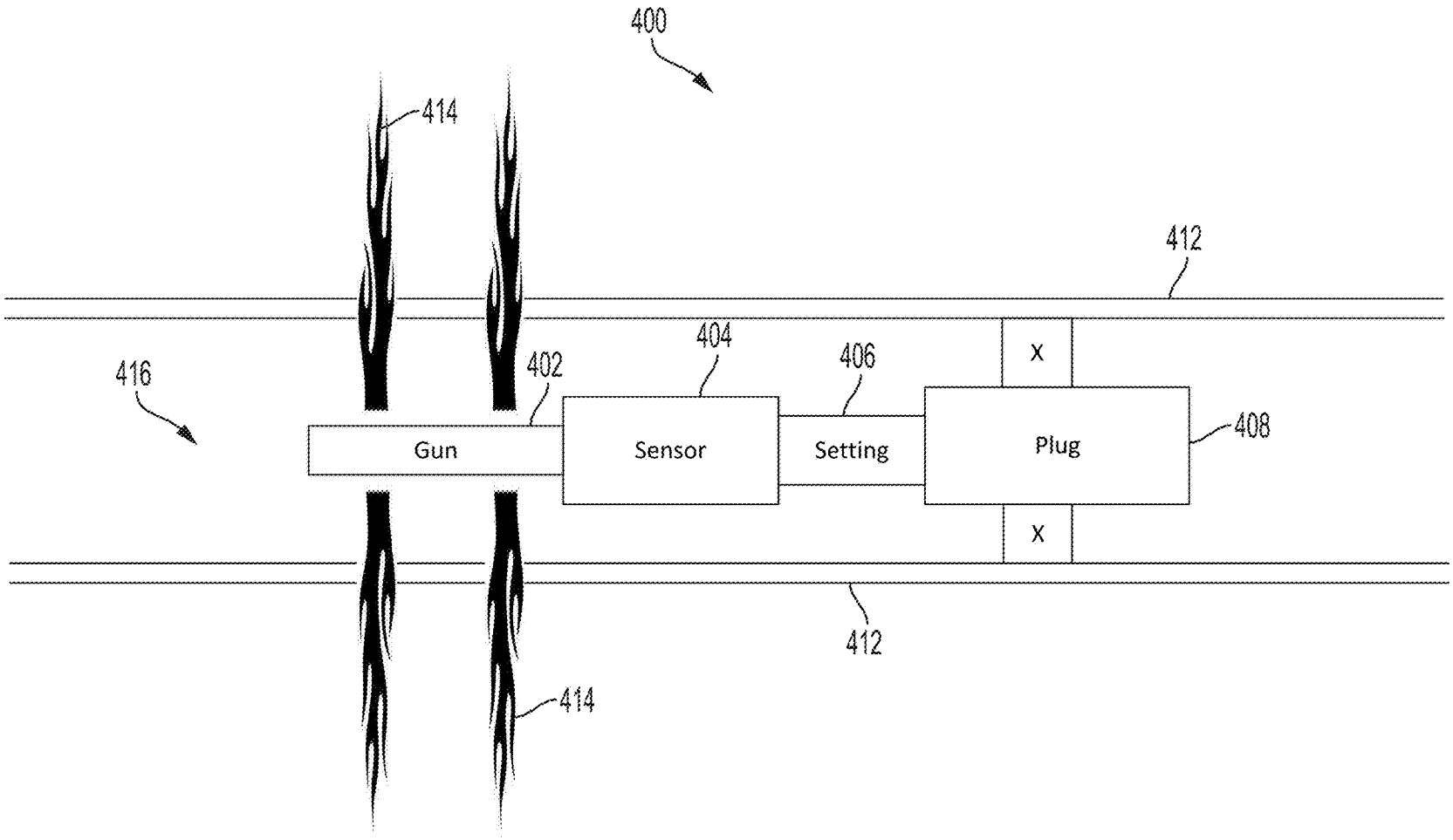
FIG. 4 illustrates a smart sensor fracturing system, in accordance with various aspects of the subject technology.

FIG. 4 illustrates a smart sensor fracturing system 400, in accordance with various aspects of the subject technology. In some instances, the smart sensor fracturing system 400 can include a gun 402, a sensor 404, a setting tool 406, and a fracturing plug 408. The smart sensor fracturing system 400 can utilize a casing 412 that can encapsulate a wellbore 416. Furthermore, as described above, the fracturing plug can plug the wellbore 416 to inhibit movement of fluids within the wellbore 416.

The smart sensor fracturing system 400 can perform an intervention-less plug-and-perf stimulation where there is no wireline or a coiled tubing in the wellbore 416. The smart sensor fracturing system 400 can further be an electronically-activated tool that can seek to use utilize the sensor 404 to perform sensor measurements during the fracturing process.

Gun:

In some instances, the gun 402 of the smart sensor fracturing system 400 can include battery-powered/wired-powered electronics that can fire 414 the gun 402 within the wellbore 416 to form perforation clusters 418 (e.g., cluster of apertures/holes) in the casing 412 and to activate the fracturing plug's 408 setting tool 406. In some instances, the smart sensor fracturing system 400 can include more than one gun 402 to form a plurality of holes in the casing 412. The gun 402 can further be positionable to form perforation clusters 418 in various locations of the casing 412. In some instances, the gun 402 can form perforation clusters 418 on opposite sides or at a particular angle from one another. Each of the perforation clusters 418 (e.g., each of the holes) can include a varying hole diameter that can be based on the application and/or requested specifications for the fracturing process.

Setting Tool:

In other instances, the setting tool 406 of the smart sensor fracturing system 400 can be used for initiating the setting of the fracturing plug 408 and/or the firing of the perforating guns 402.

In some instances, the setting tool 406 of the smart sensor fracturing system 400 can be a mechanical setting tool set that can operate drillable tools. The mechanical setting tool can run on tubing or drillpipe and can be operated by workstring rotation and reciprocation. The load transfer feature of the mechanical setting tool can limit the amount of string weight that can be applied to a sliding valve. This feature can assist in ensuring that a packer mandrel is placed in compression rather than in tension, making the mechanical setting tool more resistant to breakage.

In other instances, the setting tool 406 of the smart sensor fracturing system 400 can be a hydraulic setting tool set can operate drillable packers and plugs with workstring pressure. The hydraulic setting tool set may not have a mechanism for operating tools once the hydraulic setting tool is set. As the hydraulic setting tool may not use plugs or balls for operation, the hydraulic setting tool can be ideal for horizontal applications.

In some instances, hydraulic setting tools can be used for applications in which pulling forces may be necessary to set packers or plugs downhole. For example, the hydraulic setting tool can be used to set cast-iron bridge plugs, Fas Drill® plugs and packers, permanent packers, or squeeze cement retainers. The hydraulic setting tools can also be used for any application in which a conventional wireline setting tool may be used.

Sensors:

In some instances, the smart sensor fracturing system 400 can include a plurality of sensors 404. In other instances, the smart sensor fracturing system 400 can include electronics such as memory to store data and instructions, and a processor to execute the instructions stored in the memory. The electronics and/or the sensors 404 of the smart sensor fracturing system 400 can measure pressure and temperature parameters during the fracturing process.

In other instances, the sensors 404 of the smart sensor fracturing system 400 can include measuring stress, strain, acoustics, vibration fracture growth rates, treatment rates, or any other parameter suitable for the intended purpose and understood by a person of ordinary skill in the art. Furthermore, the sensors 404 of the smart sensor fracturing system 400 can measure the position of the drill bit in relation to the bottom of the wellbore, a rotational speed of the drill bit, whether there is a flow of fluid in the wellbore, the relative position of the pipe to determine whether the pipe is moving up, static, or moving down, whether the slips are in or not, or whether the micro-activity is brief or long.

In some instances, the sensors 404 can measure surrounding subterranean parameters and operating parameters of the smart sensor fracturing system 400. The smart sensor fracturing system 400 can further record and store the stimulation process, and the measured data and parameters to be utilized by an operator in real-time or future use.

In other instances, the sensors 404 and the setting tool 406 of the smart sensor fracturing system 400 can form a single unit. For example, the smart sensor fracturing system 400 can include a combination of an electronic setting tool 406 and an electronic sensor tool 404 for hydraulic fracturing. The electronics of the setting tool 406 and the electronics of the sensor 404 can be mechanically coupled to one another other (e.g., in the same pressure housing, on the same circuit board, and/or sharing the same battery/power supply).

In FIG. 4, the sensor 404 of the smart sensor fracturing system 400 is illustrated as being positioned between the gun 402 and the setting tool 406. However, the sensor 404 can be positioned in any arrangement with regard to the gun 402, the setting tool 406, and the fracturing plug 408. For example, the sensor 404 may be positioned before the gun 402 or between the setting tool 406 and the fracturing plug 408.

In some instances, the sensors 404 of the smart sensor fracturing system 400 can be distributed throughout the wellbore 416. For example, a sensor 404 may be distributed every 50 yards to obtain information of the surroundings in and near the wellbore 416. Varying distances between the sensors 404 is envisioned in this disclosure that are suitable for the intended purpose and understood by a person of ordinary skill in the art. Furthermore, each of the sensors 404 (e.g., distributed throughout the wellbore 416) may be communicatively coupled such that one of the sensors may wirelessly/wiredly provide measured data to the next sensor, which can then be routed to the surface (e.g., to an operator or network). In some instances, the smart sensor fracturing system 400 may include one or more transponders that can be configured to communicate with the sensors 404 and the surface. The transponders may be distributed throughout the wellbore 416 to ensure sufficient communication with the sensors 404. In other instances, the sensors 404 may be configured to communicate with the surface (e.g., the operator or network) wirelessly.

In other instances, the information provided by the sensors 404 of the smart sensor fracturing system 400 can be utilized by an operator in real-time to determine if changes need to be made to the fracturing process to facilitate optimum procedures. As it very difficult to determine operating parameters of a tool when it is downhole, the sensors 404 can provide valuable data to the operator to adjust settings to the fracturing process accordingly.

In some instances, the sensor 404 of the smart sensor fracturing system 400 may be enclosed in a sensor container to facilitate travel in the wellbore 416. For example, the sensor container may be in the shape of a pill, a sphere, an elongated tube, a cube, a cylindrical-shaped object, a rectangular-shaped object, or any other shape suitable for the intended purpose and understood by a person of ordinary skill in the art.

Electronics:

In some instances, the smart sensor fracturing system 400 can include downhole electronics for supporting plug-and-perf without a wireline. While other portions of the smart sensor fracturing system 400 can be dissolvable, the battery and the downhole electronics may not dissolve.

Figure 5A:
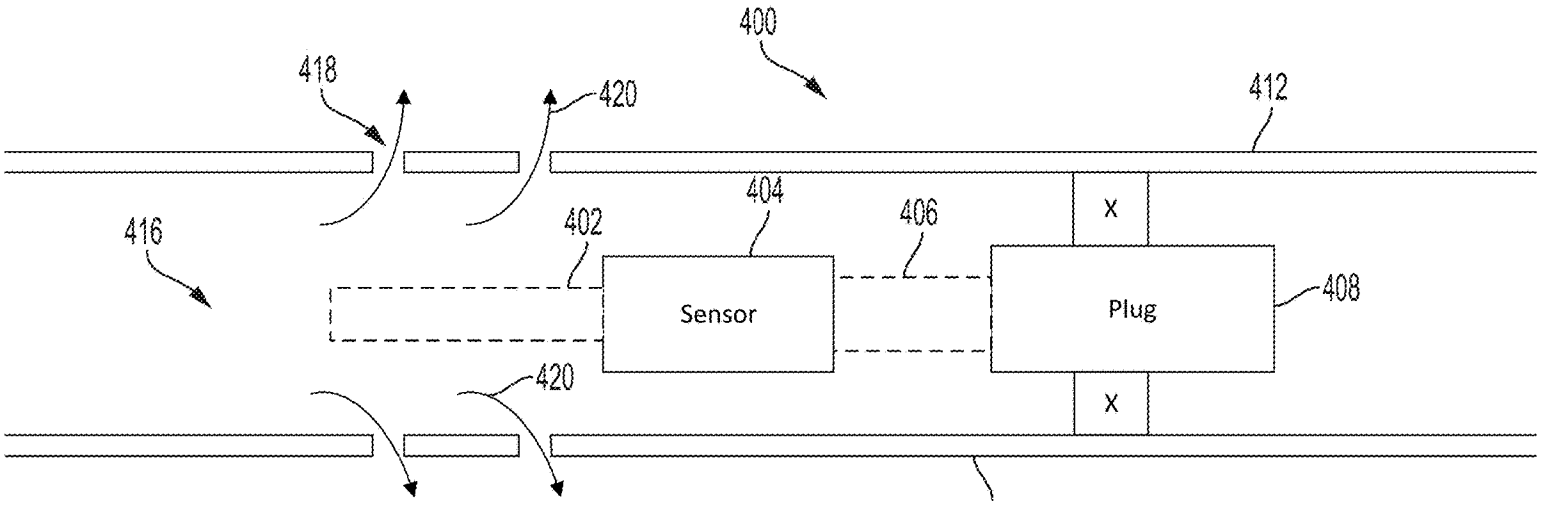
FIG. 5A illustrates the smart sensor fracturing system of FIG. 4 injecting fluids into a portion of a subterranean formation, in accordance with various aspects of the subject technology.

FIG. 5A illustrates the smart sensor fracturing system of FIG. 4 injecting fluids into a portion of a subterranean formation, in accordance with various aspects of the subject technology. As shown in FIG. 5A, fracturing fluid (as described above) can flow from the wellbore 416 to the subterranean formation 420 through the perforation clusters 418 created by the gun 402 of the smart sensor fracturing system 400.

Dissolving Elements:

In some instances, the smart sensor fracturing system 400 can perform a plug-and-perf with untethered dissolvable guns 402, the setting tool 406, and the fracturing plug 408. One or more of the gun 402, the setting tool 406, and the fracturing plus 408 can dissolve in wellbore fluid under certain applications. For example, FIG. 5A illustrates the gun 402 and the setting tool 406 as being dissolvable components in dashed lines. In other applications, one or more of the gun 402, the setting tool 406, and the fracturing plus 408 can dissolve in wellbore fluid. In some instances, the exterior of the guns 402, the setting tool 406, and the fracturing plug 408 may be made of a magnesium alloy, an aluminum alloy, a polymer that degrades with time and temperature (e.g., a polyurethane or a polyester), bulk metallic glass, or any other dissolvable material suitable for the intended purpose and understood by a person of ordinary skill in the art. In other instances, the guns 402, the setting tool 406, and the fracturing plug 408 may dissolve, but the electronics and batteries may not dissolve in the wellbore 416.

In some instances, the guns 402 and the setting tool 406 can dissolve in the wellbore fluids. For example, the wellbore fluids can be an acid, salt water, or any other liquid/fluid suitable for the intended purpose and understood by a person of ordinary skill in the art that may be used during the stimulation process. The acid may accelerate the dissolution of the gun 402 and the setting tool 406. The fracturing plug 408 can be configured to avoid dissolution until after the stimulation is completed. For example, the fracturing plug 408 can include an exterior coating or a fluid separator to minimize interaction with the acidic dissolution. Other examples of an exterior material that may not dissolve is stainless steel, a polymer composition that is meant to not dissolve, and a material with a low specific gravity.

Figure 5B:
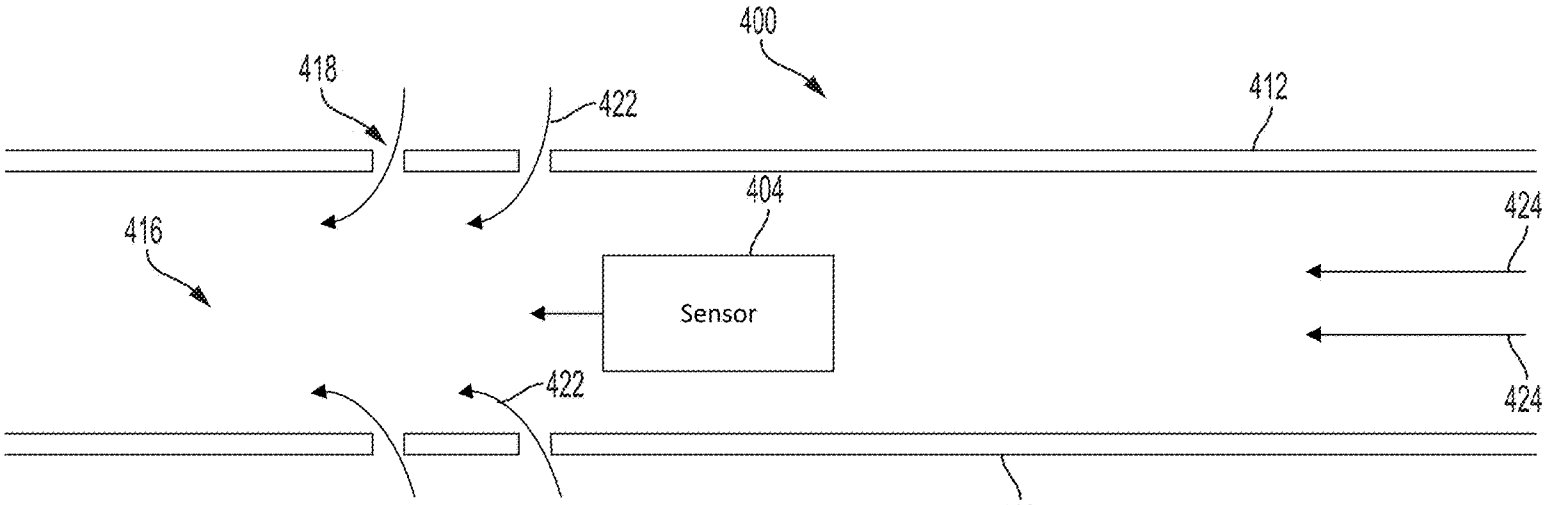
FIG. 5B illustrates the smart sensor fracturing system of FIG. 4 ejecting fluids from a portion of a subterranean formation, in accordance with various aspects of the subject technology.

FIG. 5B illustrates the smart sensor fracturing system of FIG. 4 ejecting fluids from a portion of a subterranean formation, in accordance with various aspects of the subject technology.

In some instances, when the fracturing process is completed, the wellbore 416 of the smart sensor fracturing system 400 can be placed into production. In this instance, the electronics module (e.g., including the sensors 404) can be retrieved back to the surface for collecting of the measured data when the subterranean fluid 422 is received 424. In other instances, after the sensors 404 is retrieved, an operator can access the sensors 404 (e.g., by plugging the sensor 404 into a computer or connecting to the sensor 404 wirelessly via Bluetooth or other wireless communication) and utilized the measured information and data for future fracturing processes.

Figure 6:
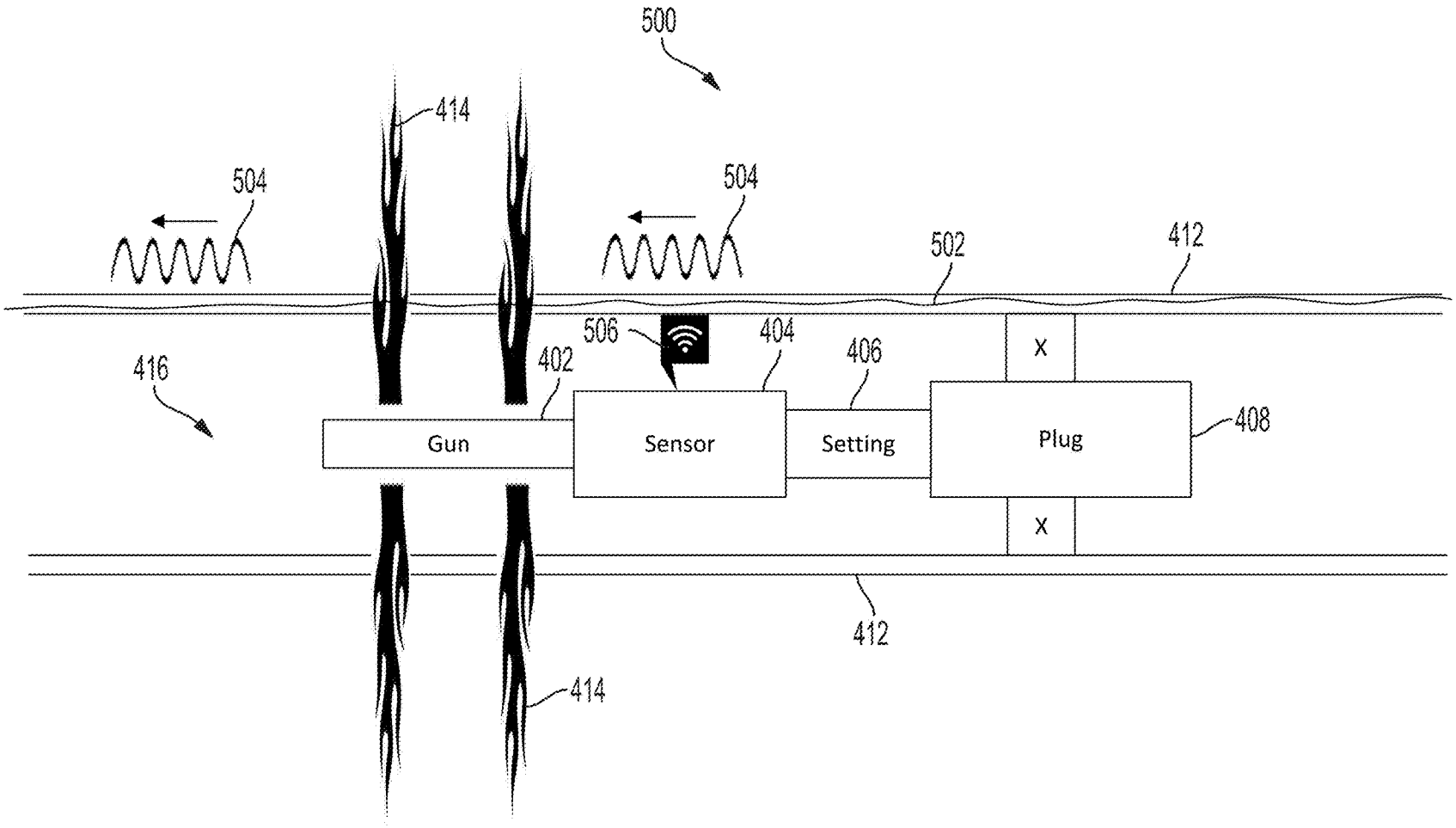
FIG. 6 illustrates a smart sensor fracturing system along with a data line, in accordance with various aspects of the subject technology.

FIG. 6 illustrates a smart sensor fracturing system 500 along with a data line 502, in accordance with various aspects of the subject technology. The smart sensor fracturing system 500 may be similar to the smart sensor fracturing system 400 as described above.

Data line:

In some instances, the smart sensor fracturing system 500 can include a downhole data line 502 (e.g., a fiber optic data line) that can be communicatively coupled 506 to the sensors 404 of the smart sensor fracturing system 500. The downhole data line 502 can receive 504 data and/or signals from the sensors 404 and its surroundings, and provide the data upstream to an operator or fracturing monitoring network.

Examples of the downhole data line 502 can further include a Distributed Temperature Sensing (DTS) system, a Distributed Acoustic Sensing System, a Distributed Strain Sensing (DSS) System, a quasi-distributed sensing systems wherein multiple single point sensors are distributed along a fiber optic line, or a single point sensing systems wherein the sensors are located at an end of the fiber optic lines.

The downhole data line 502 can operate using various sensing principles including, but not limited to, an amplitude based sensing system (e.g., a DTS system based on Raman scattering); a phase sensing based system (e.g., a DAS system based on interferometric sensing using, for example, homodyne or heterodyne techniques where the system can sense phase or intensity changes due to constructive or destructive interference); a strain sensing system (e.g., a DSS using dynamic strain measurements based on interferometric sensors or static strain sensing measurements using, for example, Brillouin scattering); quasi-distributed sensors based on, for example, Fiber Bragg Gratings (FBGs) wherein a wavelength shift is detected or multiple FBGs are used to form Fabry-Perot type interferometric sensors for phase or intensity based sensing; or single point fiber optic sensors based on Fabry-Perot or FBG or intensity based sensors.

In some instances, the downhole data line 502 of the smart sensor fracturing system 500 can include one or more data lines. The downhole data line 502 can include single mode fibers, multi-mode fibers, or a combination of single mode and/or multi-mode optical fibers. The downhole data line 502 can also include one or more layers of a protective buffer coating to minimize bend stress and/or to protect against environmental stresses (i.e., abrasion, chemical attack, hydrocarbons, fracturing fluids, etc.). The protective buffer coating can include, but is not limited to, metallic alloys, polyimide, polyether ether keytone, silicone, polyvinylidene fluoride, or acrylate.

In other instances, measurement data obtained by the sensors 404 can be received by a computer (e.g., a computing device architecture) from each of the one or more data lines 502 after deployment of the one or more data lines 502. The measurement data can be received wirelessly from the sensors 404 to a computing device or other device for storage and/or processing. The measured data can correspond to characteristics of the control wellbore and/or the monitoring wellbore.

The electronics of the smart sensor fracturing system 500 can further include a telemetry component (not shown) in addition to the sensor component 402. The telemetry component can also be communicatively coupled to the data line. For example, the sensor data can be digitally encoded into acoustic vibrations that can be sensed by a fiber optic distributed acoustic sensing (DAS) cable.

Figure 7A:
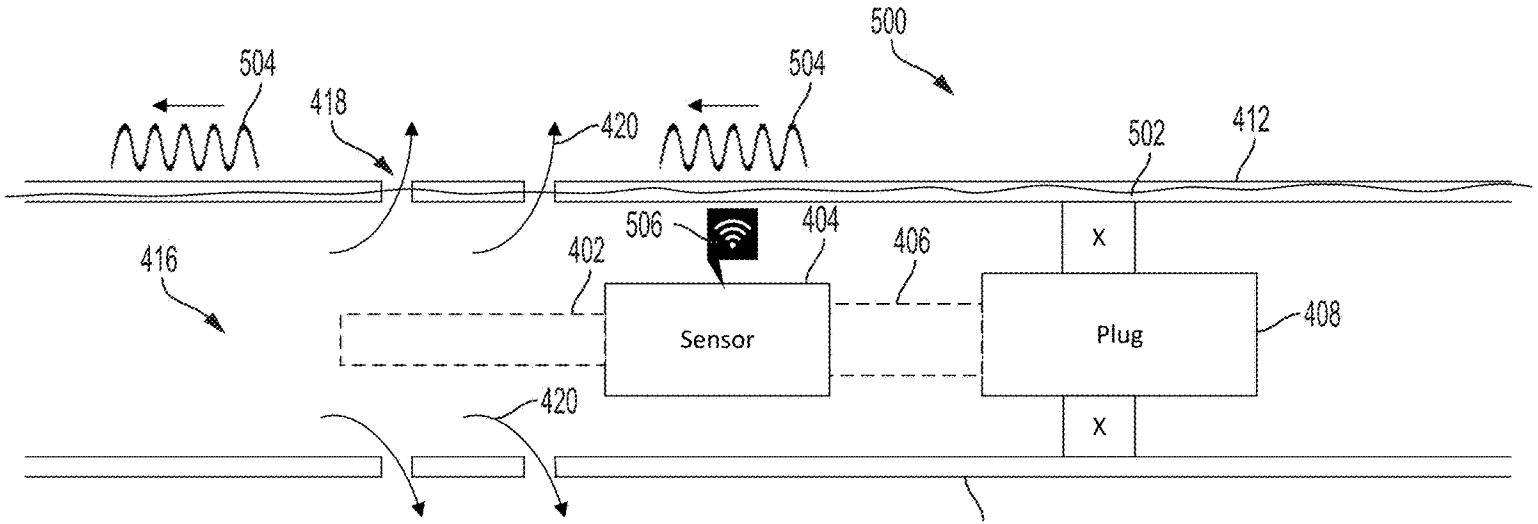
FIG. 7A illustrates the smart sensor fracturing system of FIG. 6 injecting fluids into a portion of a subterranean formation, in accordance with various aspects of the subject technology.

FIG. 7A illustrates the smart sensor fracturing system of FIG. 6 injecting fluids into a portion of a subterranean formation, in accordance with various aspects of the subject technology. As shown in FIG. 7A, fracturing fluid (as described above) can flow from the wellbore 416 to the subterranean formation 420 through the perforation clusters 418 created by the gun 402 of the smart sensor fracturing system 500.

Dissolving Elements:

In some instances, the smart sensor fracturing system 500 can perform a plug-and-perf with untethered dissolvable guns 402, the setting tool 406, and the fracturing plug 408. One or more of the gun 402, the setting tool 406, and the fracturing plus 408 can dissolve in wellbore fluid under certain applications. For example, FIG. 7A illustrates the gun 402 and the setting tool 406 as being dissolvable components in dashed lines. In other applications, one or more of the gun 402, the setting tool 406, and the fracturing plus 408 can dissolve in wellbore fluid. In some instances, the exterior of the guns 402, the setting tool 406, and the fracturing plug 408 may be made of a magnesium alloy, an aluminum alloy, a polymer that degrades with time and temperature (e.g., a polyurethane or a polyester), bulk metallic glass, or any other dissolvable material suitable for the intended purpose and understood by a person of ordinary skill in the art. In other instances, the guns 402, the setting tool 406, and the fracturing plug 408 may dissolve, but the electronics and batteries may not dissolve in the wellbore 416.

In some instances, the guns 402 and the setting tool 406 can dissolve in the wellbore fluids. For example, the wellbore fluids can be an acid, salt water, or any other liquid/fluid suitable for the intended purpose and understood by a person of ordinary skill in the art that may be used during the stimulation process. The acid may accelerate the dissolution of the gun 402 and the setting tool 406. The fracturing plug 408 can be configured to avoid dissolution until after the stimulation is completed. For example, the fracturing plug 408 can include an exterior coating or a fluid separator to minimize interaction with the acidic dissolution. Other examples of an exterior material that may not dissolve is stainless steel, a polymer composition that is meant to not dissolve, and a material with a low specific gravity.

Figure 7B:
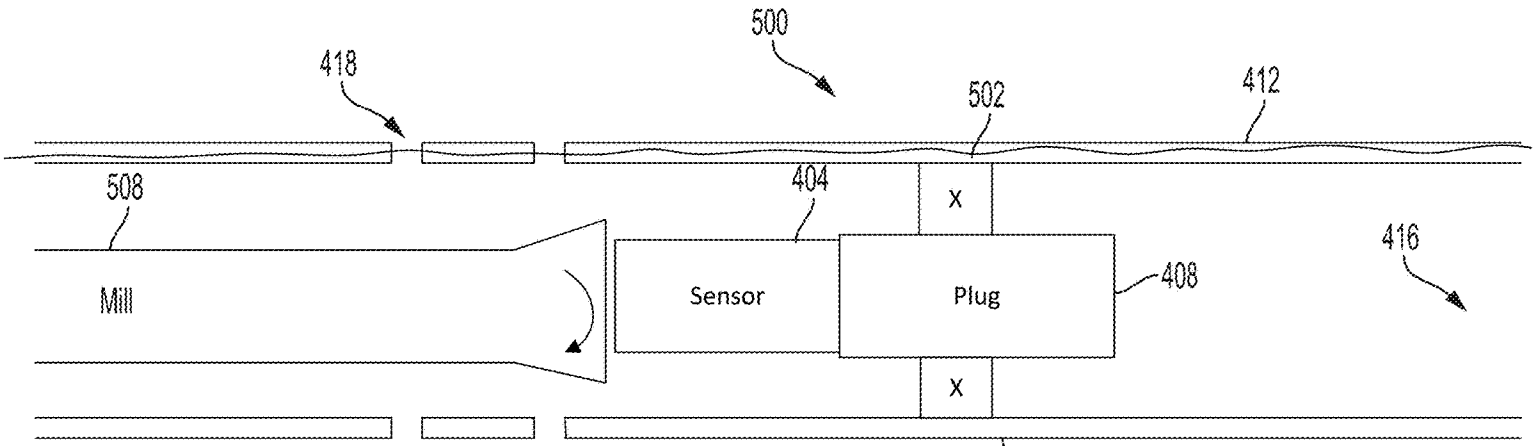
FIG. 7B illustrates the smart sensor fracturing system of FIG. 6 milling a sensor, in accordance with various aspects of the subject technology.

FIG. 7B illustrates the smart sensor fracturing system of FIG. 6 milling a sensor, in accordance with various aspects of the subject technology.

In some instances, the sensors 404 (which may include the electronics) of the smart sensor fracturing system 500 can provide measured data in real-time during the fracturing operation. Moreover, as shown in FIG. 7B, there may be instances where milling operation 508 is required to remove the fracturing plug 408. In such an instance, the sensor information retrieved from the sensors 404 will have already been obtained by the smart sensor fracturing system 400, 500. As such, destruction of the sensor 404 from the milling operation 508 will not deter the measured information from reaching the operator or the fracturing network.

Having disclosed example systems, methods, and technologies for using a real-time predictive analysis to improve monitoring of drilling operations, the disclosure now turns to FIG. 8, which illustrates an example computing device architecture 800 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 8 illustrates an example computing device architecture 800 of a computing device which can implement the various technologies and techniques described herein. For example, the computing device architecture 800 can implement the above-mentioned systems and perform various steps, methods, and techniques disclosed herein. The components of the computing device architecture 800 are shown in electrical communication with each other using a connection 805, such as a bus. The example computing device architecture 800 includes a processing unit (CPU or processor) 810 and a computing device connection 805 that couples various computing device components including the computing device memory 815, such as read only memory (ROM) 820 and random access memory (RAM) 825, to the processor 810.

The computing device architecture 800 can include a cache of high-speed memory connected directly with, in close proximity to, or integrated as part of the processor 810. The computing device architecture 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other computing device memory 815 may be available for use as well. The memory 815 can include multiple different types of memory with different performance characteristics. The processor 810 can include any general purpose processor and a hardware or software service, such as service 1 832, service 2 834, and service 3 836 stored in storage device 830, configured to control the processor 810 as well as a special-purpose processor where software instructions are incorporated into the processor design. The processor 810 may be a self-contained system, containing multiple cores or processors, a bus, memory controller, cache, etc. A multi-core processor may be symmetric or asymmetric.

To enable user interaction with the computing device architecture 800, an input device 845 can represent any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art, such as a display, projector, television, speaker device, etc. In some instances, multimodal computing devices can enable a user to provide multiple types of input to communicate with the computing device architecture 800. The communications interface 840 can generally govern and manage the user input and computing device output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 825, read only memory (ROM) 820, and hybrids thereof. The storage device 830 can include services 832, 834, 836 for controlling the processor 810. Other hardware or software modules are contemplated. The storage device 830 can be connected to the computing device connection 805. In one aspect, a hardware module that performs a particular function can include the software component stored in a computer-readable medium in connection with the necessary hardware components, such as the processor 810, connection 805, output device 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A system comprising: a fracturing plug configured to seal a wellbore to prevent fluid from passing through the wellbore; a gun configured to generate a perforation cluster, wherein the perforation cluster allows fluid exchange between the wellbore and a subterranean formation; a setting tool configured to initiate setting of the fracturing plug and firing of the gun to generate the perforation cluster; and a sensor configured to measure parameters proximate to the wellbore, wherein the sensor is retrievable after a fracturing process.

Statement 2: A system according to Statement 1, wherein the fracturing plug, the gun, and the setting tool are dissolvable.

Statement 3: A system according to any of Statements 1 and 2, wherein the perforation clusters include a plurality of holes that allow the fluid exchange between the wellbore and the subterranean formation.

Statement 4: A system according to any of Statements 1 through 3, wherein the perforation clusters include varying diameters that are based on the type of the fracturing process.

Statement 5: A system according to any of Statements 1 through 4, wherein the parameters measured by the sensor include at least one of a temperature parameter and a pressure parameter.

Statement 6: A system according to any of Statements 1 through 5, further comprising a plurality of sensors including the sensor that are distributed throughout the wellbore.

Statement 7: A system according to any of Statements 1 through 6, further comprising a transponder that is configured to be communicatively coupled to the plurality of sensors.

Statement 8: A system according to any of Statements 1 through 7, wherein the transponder is configured to: receive the measured parameters from the plurality of sensors; and transmit the measured parameters to an operator.

Statement 9: A system according to any of Statements 1 through 8, further comprising: a casing that encapsulates the wellbore; and a data line embedded within the casing that is configured to be communicatively coupled to the sensor.

Statement 10: A system according to any of Statements 1 through 9, wherein the data line is a fiber optic cable that is configured to wirelessly receive the measured parameters from the sensor.

Statement 11: A method comprising: providing a fracturing system comprising: a fracturing plug configured to seal a wellbore to prevent fluid from passing through the wellbore; a gun configured to generate a perforation cluster, wherein the perforation cluster allows fluid exchange between the wellbore and a subterranean formation; a setting tool configured to initiate setting of the fracturing plug and firing of the gun to generate the perforation cluster; and a sensor configured to measure parameters proximate to the wellbore, wherein the sensor is retrievable after a fracturing process; measuring the parameters proximate to the wellbore with the sensor; and transmitting the parameters measured by the sensor to an operator.

Statement 12: A method according to Statement 11, wherein the fracturing plug, the gun, and the setting tool are dissolvable.

Statement 13: A method according to any of Statements 11 and 12, wherein the perforation clusters include a plurality of apertures that allow the fluid exchange between the wellbore and the subterranean formation.

Statement 14: A method according to any of Statements 11 through 13, wherein the perforation clusters include varying diameters that are based on the type of the fracturing process.

Statement 15: A method according to any of Statements 11 through 14, wherein the measuring of the parameters includes measuring at least one of a temperature parameter and a pressure parameter.

Statement 16: A method according to any of Statements 11 through 15, wherein the fracturing system further comprises a plurality of sensors including the sensor that are distributed throughout the wellbore.

Statement 17: A method according to any of Statements 11 through 16, wherein the fracturing system further comprises a transponder that is configured to be communicatively coupled to the plurality of sensors.

Statement 18: A method according to any of Statements 11 through 17, further comprising: receiving, at the transponder, parameter measurements from the plurality of sensors; and transmitting the parameter measurements from the plurality of sensors to the operator.

Statement 19: A method according to any of Statements 11 through 18, wherein the fracturing system further comprises: a casing that encapsulates the wellbore; and a data line embedded within the casing that is configured to be communicatively coupled to the sensor.

Statement 20: A method according to any of Statements 11 through 19, further comprising receiving the measured parameters from the sensor by the data line, wherein the data line is a fiber optic cable.

What is claimed is:

1. A system comprising:

a fracturing plug configured to seal a wellbore to prevent fluid from passing through the wellbore;

a gun configured to generate a perforation cluster, wherein the perforation cluster allows fluid exchange between the wellbore and a subterranean formation;

a setting tool configured to initiate setting of the fracturing plug and firing of the gun to generate the perforation cluster; and a sensor configured to measure parameters proximate to the wellbore, wherein the sensor is retrievable after a fracturing process and is included as part of a plurality of sensors distributed throughout the wellbore.

2. The system of claim 1, wherein at least one of the fracturing plug, the gun, and the setting tool are dissolvable.

3. The system of claim 1, wherein the perforation clusters include a plurality of apertures that allow the fluid exchange between the wellbore and the subterranean formation.

4. The system of claim 1, wherein the perforation clusters include varying diameters that are based on the type of the fracturing process.

5. The system of claim 1, wherein the parameters measured by the sensor include at least one of a temperature parameter and a pressure parameter.

6. The system of claim 1, further comprising a transponder that is configured to be communicatively coupled to the plurality of sensors.

7. The system of claim 6, wherein the transponder is configured to:

receive the measured parameters from the plurality of sensors; and transmit the measured parameters to an operator.

8. The system of claim 1, further comprising:

a casing that encapsulates the wellbore; and a data line embedded within the casing that is configured to be communicatively coupled to the sensor.

9. The system of claim 8, wherein the data line is a fiber optic cable that is configured to wirelessly receive the measured parameters from the sensor.

10. A method comprising:

providing a fracturing system comprising:

a fracturing plug configured to seal a wellbore to prevent fluid from passing through the wellbore;

a gun configured to generate a perforation cluster, wherein the perforation cluster allows fluid exchange between the wellbore and a subterranean formation;

a setting tool configured to initiate setting of the fracturing plug and firing of the gun to generate the perforation cluster; and a sensor configured to measure parameters proximate to the wellbore, wherein the sensor is retrievable after a fracturing process and is included as part of a plurality of sensors distributed throughout the wellbore;

measuring the parameters proximate to the wellbore with the sensor; and transmitting the parameters measured by the sensor to an operator.

11. The method of claim 10, wherein at least one of the fracturing plug, the gun, and the setting tool are dissolvable.

12. The method of claim 10, wherein the perforation clusters include a plurality of apertures that allow the fluid exchange between the wellbore and the subterranean formation.

13. The method of claim 10, wherein the perforation clusters include varying diameters that are based on the type of the fracturing process.

14. The method of claim 10, wherein the measuring of the parameters includes measuring at least one of a temperature parameter and a pressure parameter.

15. The method of claim 10, wherein the fracturing system further comprises a transponder that is configured to be communicatively coupled to the plurality of sensors.

16. The method of claim 15, further comprising:

receiving, at the transponder, parameter measurements from the plurality of sensors; and transmitting the parameter measurements from the plurality of sensors to the operator.

17. The method of claim 10, wherein the fracturing system further comprises:

a casing that encapsulates the wellbore; and a data line embedded within the casing that is configured to be communicatively coupled to the sensor.

18. The method of claim 17, further comprising receiving the measured parameters from the sensor by the data line, wherein the data line is a fiber optic cable.

* * * * *